US011543131B2

(12) United States Patent
Jeong

(10) Patent No.: US 11,543,131 B2
(45) Date of Patent: Jan. 3, 2023

(54) NOZZLE ASSEMBLY, COMBUSTOR, AND GAS TURBINE HAVING SAME

(71) Applicant: DOOSAN ENERBILITY CO., LTD, Changwon (KR)

(72) Inventor: Han Jin Jeong, Guri (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/548,498

(22) Filed: Dec. 11, 2021

(65) Prior Publication Data

US 2022/0228741 A1 Jul. 21, 2022

(30) Foreign Application Priority Data

Jan. 18, 2021 (KR) ..... 10-2021-0006860

(51) Int. Cl.

*F23R 3/28* (2006.01)
*F23R 3/14* (2006.01)
*F23R 3/16* (2006.01)

(52) U.S. Cl.

CPC ..... *F23R 3/283* (2013.01); *F23R 3/14* (2013.01); *F23R 3/286* (2013.01); *F23R 3/16* (2013.01); *F23R 3/28* (2013.01)

(58) Field of Classification Search

CPC ..... F23R 3/14; F23R 3/16; F23R 3/28; F23R 3/283; F23R 3/286

See application file for complete search history.

(56) References Cited

U.S. PATENT DOCUMENTS

| | | | | |
|---|---|---|---|---|
| 11,274,832 | B2 * | 3/2022 | Tada | F02C 7/18 |
| 11,339,969 | B2 * | 5/2022 | Asai | F23R 3/343 |
| 2004/0003598 | A1 * | 1/2004 | Farhangi | F23R 3/40 60/777 |
| 2009/0293484 | A1 * | 12/2009 | Inoue | F23R 3/286 60/740 |
| 2012/0180487 | A1 * | 7/2012 | Uhm | F23R 3/286 60/737 |
| 2013/0213051 | A1 * | 8/2013 | Westmoreland, III | F23R 3/286 60/776 |

(Continued)

FOREIGN PATENT DOCUMENTS

| | | | |
|---|---|---|---|
| JP | 2001-280641 | A | 10/2001 |
| KR | 10-2019-0128232 | A | 11/2019 |

*Primary Examiner* — William H Rodriguez
(74) *Attorney, Agent, or Firm* — Harvest IP Law LLP

(57) ABSTRACT

A nozzle assembly for injecting fuel and compressed air into a combustion chamber of a gas turbine combustor is provided. The nozzle assembly includes a nozzle body disposed in the combustor and having a coolant outlet on one end of which an inside of the nozzle body communicates with the combustion chamber, a spray nozzle disposed in the nozzle body and including a plurality of first nozzle tubes each having a first flow path formed therein to allow combustion air to flow into the combustion chamber and a fuel hole formed to supply fuel, and a second nozzle tube having through-holes to allow the first nozzle tubes to pass therethrough and a second flow path formed to supply fuel, and a diaphragm disposed inside of the nozzle body and including a plurality of coolant flow holes through which a coolant supplied to the nozzle body is supplied towards one end of the nozzle body and a plurality of tube holes through which the first nozzle tubes pass.

20 Claims, 6 Drawing Sheets

(56) References Cited

U.S. PATENT DOCUMENTS

| | | | | |
|---|---|---|---|---|
| 2013/0232979 | A1* | 9/2013 | Singh | F23R 3/286 60/737 |
| 2014/0053571 | A1* | 2/2014 | Keener | F23R 3/283 60/782 |
| 2015/0167981 | A1* | 6/2015 | Woods | F23R 3/286 239/408 |
| 2015/0241065 | A1* | 8/2015 | Hughes | F23R 3/283 60/737 |
| 2016/0033133 | A1* | 2/2016 | Johnson | F23R 3/286 60/737 |
| 2016/0102863 | A1* | 4/2016 | Yoshino | F23R 3/286 239/428 |
| 2017/0254539 | A1* | 9/2017 | Melton | F23D 14/02 |
| 2018/0051632 | A1* | 2/2018 | Word | F23R 3/286 |
| 2018/0163968 | A1* | 6/2018 | Bailey | F23R 3/286 |
| 2018/0172273 | A1* | 6/2018 | Purcell | F23R 3/286 |
| 2018/0187603 | A1* | 7/2018 | Berry | F23R 3/32 |
| 2019/0360697 | A1* | 11/2019 | Tada | F23D 14/62 |
| 2021/0095849 | A1* | 4/2021 | Asai | F23R 3/46 |
| 2021/0102703 | A1* | 4/2021 | Tada | F02C 7/22 |

* cited by examiner

NOZZLE ASSEMBLY, COMBUSTOR, AND GAS TURBINE HAVING SAME

CROSS REFERENCE TO RELATED APPLICATION

This application claims priority to Korean Patent Application No. 10-2021-0006860, filed on Jan. 18, 2021, the disclosure of which is incorporated herein by reference in its entirety.

BACKGROUND

1. Field

Apparatuses and methods consistent with exemplary embodiments relate to a nozzle assembly, a combustor, and a gas turbine including the same and, more particularly, to a nozzle assembly provided in a combustor of a gas turbine to inject fuel and compressed air into a combustion chamber of the combustor, a combustor having the nozzle assembly, and a gas turbine having the same.

2. Description of the Related Art

A turbomachine refers to an apparatus that generates a driving force used to generate power with a fluid (e.g., gas) passing through the turbomachine. Therefore, the turbomachine is usually installed and used together with a generator. The turbomachine may include a gas turbine, a steam turbine, a wind power turbine, and the like. The gas turbine is an apparatus that mixes compressed air and natural gas and combusts an air-fuel mixture to generate combustion gas, and generates power for power generation by using the combustion gas. The steam turbine is an apparatus that heats water to generate steam and generates power for power generation by using the steam. The wind turbine is an apparatus that converts wind power into power for power generation.

A gas turbine includes a compressor, a combustor, and a turbine. The compressor includes a plurality of compressor vanes and a plurality of compressor blades alternately arranged in a compressor casing with an air inlet through which air is introduced. The introduced air is compressed by the compressor vanes and the compressor blades while passing through an inside of the compressor. The combustor supplies fuel to the compressed air compressed by the compressor to form a fuel-air mixture.

In addition, the combustor ignites the fuel-air mixture with an igniter to generate high-temperature and high-pressure combustion gas. The generated combustion gas is supplied to the turbine. The turbine includes a plurality of turbine vanes and turbine blades alternately arranged in a turbine casing. The combustion gas generated by the combustor rotates the turbine blades while passing through an inside of the turbine and then is discharged to outside through a turbine diffuser.

A steam turbine includes an evaporator and a turbine. The evaporator heats water supplied from the outside to generate steam. The turbine of the steam turbine includes a plurality of turbine vanes and a plurality of turbine blades alternately disposed in a turbine casing. While the gas turbine uses the combustion gas, the steam turbine uses the steam generated in the evaporator to rotate the turbine blades.

In a gas turbine, hydrogen may be used as a fuel. However, the hydrogen gas turbine has a problem in that due to the nature of hydrogen combustion, when a mixture of hydrogen and compressed air is combusted in a combustion chamber of the combustor, a flame holding phenomenon occurs in which the flame is held around a spray nozzle and a backfire/flash back phenomenon in which a flame is directed in the reverse direction instead of toward the turbine, resulting in a tip of the spray nozzle being heated by the flame holding.

SUMMARY

Aspects of one or more exemplary embodiments provide a nozzle assembly in which a cooling fluid is supplied to a combustion chamber through a nozzle body to cool a tip of a spray nozzle and a first flow path formed in a first nozzle tube through which combustion air and fuel are supplied to the combustion chamber has a cross-section area that gradually decreases toward an outlet side thereof to increase the spray speed of combustion air and fuel so that a flame holding phenomenon or backfire/flashback phenomenon in which a flame generated in the combustion chamber of the combustor adheres to the spray nozzle or flows back can be prevented, a combustor including the nozzle assembly, and a gas turbine having the same.

Additional aspects will be set forth in part in the description which follows and, in part, will become apparent from the description, or may be learned by practice of the exemplary embodiments.

According to an aspect of an exemplary embodiment, there is provided a nozzle assembly for injecting fuel and compressed air into a combustion chamber of a gas turbine combustor, the nozzle assembly including: a nozzle body disposed in the combustor and having a coolant outlet on one end of which an inside of the nozzle body communicates with the combustion chamber communicate; a spray nozzle disposed in the nozzle body and including a plurality of first nozzle tubes, each first nozzle tube having a first flow path formed therein to allow combustion air to flow into the combustion chamber and a fuel hole formed on a circumferential surface thereof to supply fuel, and a second nozzle tube disposed adjacent to the first nozzle tube and having a plurality of through-holes to allow the first nozzle tubes to pass therethrough and a second flow path formed therein to supply fuel; and a diaphragm disposed inside of the nozzle body and including a plurality of coolant flow holes through which a coolant supplied to the nozzle body is supplied towards one end of the nozzle body and a plurality of tube holes through which the first nozzle tubes pass.

The nozzle body may have a cylindrical shape with one closed end on which the coolant outlet is formed, and the coolant outlet may include a plurality of coolant outlet holes arranged in a ring shape.

The plurality of coolant outlet holes may include a first group of coolant outlet holes arranged in a circumferential direction in the ring shape on an inner circumferential portion of the closed end of the nozzle body, and a second group of coolant outlet holes arranged in the circumferential direction in the ring shape on an outer circumferential portion of the closed end of the nozzle body.

The coolant outlet holes of the second group of coolant outlet holes may be formed to extend obliquely upward in a longitudinal direction of the nozzle body from inside to outside through the closed end of the nozzle body.

A swirler may be formed inside the first nozzle tube to mix fuel and combustion air supplied to the first nozzle tube.

The swirler may be disposed in the first flow path downstream from a position in which the fuel hole is formed based on a flow direction of combustion air flowing through the first flow path.

The first flow path may have a cross-sectional area gradually decreasing toward an outlet side thereof.

According to an aspect of another exemplary embodiment, there is provided a combustor including: a nozzle casing configured to receive compressed air from a compressor and to receive fuel from an outside; a liner connected to the nozzle casing and defining a combustion chamber in which a mixture of the compressed air-fuel is combusted; a transition piece connected to the liner to supply combustion gas generated in the combustion chamber to a turbine; and a nozzle assembly disposed in the nozzle casing to inject fuel and compressed air into the combustion chamber. The nozzle assembly including: a nozzle body disposed in the combustor and having a coolant outlet on one end of which an inside of the nozzle body communicates with the combustion chamber; a spray nozzle disposed in the nozzle body and including a plurality of first nozzle tubes, each first nozzle tube having a first flow path formed therein to allow combustion air to flow into the combustion chamber and a fuel hole formed on a circumferential surface thereof to supply fuel, and a second nozzle tube disposed adjacent to the first nozzle tube and having a plurality of through-holes to allow the first nozzle tubes to pass therethrough and a second flow path formed therein to supply fuel; and a diaphragm disposed inside of the nozzle body and including a plurality of coolant flow holes through which a coolant supplied to the nozzle body is supplied towards one end of the nozzle body and a plurality of tube holes through which the first nozzle tubes pass.

According to an aspect of another exemplary embodiment, there is provided a gas turbine including: a compressor configured to suck and compress external air; a combustor configured to mix the compressed air supplied from the compressor with fuel and combust the air-fuel mixture to produce combustion gas; and a turbine rotated by the combustion gas produced by the combustor to generate power, the combustor including: a nozzle casing; a liner connected to the nozzle casing and defining a combustion chamber in which the compressed air-fuel mixture is combusted; a transition piece connected to the liner to supply combustion gas generated in the combustion chamber to the turbine; and a nozzle assembly disposed in the nozzle casing to inject fuel and compressed air into the combustion chamber. The nozzle assembly including: a nozzle body disposed in the combustor and having a coolant outlet on one end of which an inside of the nozzle body communicates with the combustion chamber; a spray nozzle disposed in the nozzle body and including a plurality of first nozzle tubes, each first nozzle tube having a first flow path formed therein to allow combustion air to flow into the combustion chamber and a fuel hole formed on a circumferential surface thereof to supply fuel, and a second nozzle tube disposed adjacent to the first nozzle tube and having a plurality of through-holes to allow the first nozzle tubes to pass therethrough and a second flow path formed therein to supply fuel; and a diaphragm disposed inside of the nozzle body and including a plurality of coolant flow holes through which a coolant supplied to the nozzle body is supplied towards one end of the nozzle body and a plurality of tube holes through which the first nozzle tubes pass.

According to one or more exemplary embodiments, as a cooling fluid is supplied to the combustion chamber through the nozzle body, the spray nozzle can be cooled using compressed air supplied to the combustion chamber, and a swirler is provided inside of the first nozzle tube of the spray nozzle to increase the mixing efficiency of fuel and combustion air that are supplied to the first flow path of the spray nozzle, the first flow path has a cross-section area that gradually decreases toward an outlet side thereof to increase the spray speed of combustion air and fuel so that an air-fuel mixture is combusted relatively downstream side compared to a related art combustion spot to prevent a flame from adhering to the outer wall of the spray nozzle, thereby avoiding the flame holding phenomenon or backfire/flashback phenomenon.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
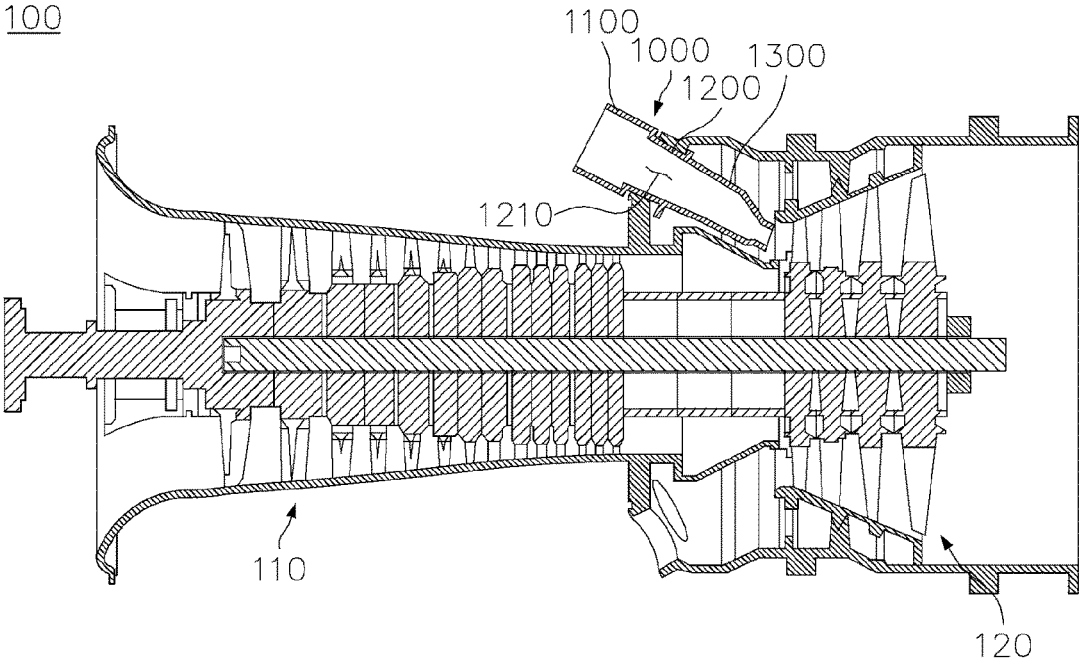
FIG. 1 is a cross-sectional view illustrating a gas turbine according to an exemplary embodiment.

Various modifications and various embodiments will be described with reference to the accompanying drawings. However, it should be noted that the various embodiments are not for limiting the scope of the disclosure to the specific embodiment, but they should be interpreted to include all modifications, equivalents, or substitutions of the embodiments included within the spirit and scope disclosed herein.

Terms used herein are used to merely describe specific embodiments and are not intended to limit the scope of the disclosure. As used herein, an element expressed as a singular form includes a plurality of elements, unless the context clearly indicates otherwise. Further, it will be understood that the term "comprising" or "including" specifies the presence of stated features, numbers, steps, operations, elements, parts, or combinations thereof, but does not preclude the presence or addition of one or more other features, numbers, steps, operations, elements, parts, or combinations thereof.

For clear illustration, components that are irrelevant to the description are omitted, and like reference numerals refer to like components throughout the specification. In certain embodiments, a detailed description of known functions and configurations that may obscure the gist of the present disclosure will be omitted. For the same reason, some of the elements in the drawings are exaggerated, omitted, or schematically illustrated.

Hereinafter, a configuration of a gas turbine according to an exemplary embodiment will be described with reference to the accompanying drawings. FIG. 1 is a cross-sectional view illustrating a gas turbine according to an exemplary embodiment.

Referring to FIG. 1, a gas turbine 100 includes a compressor 110, a combustor 1000, and a turbine 120. In a flow direction of gas (e.g., compressed air or combustion gas), the compressor 110 is disposed on an upstream side of the gas turbine 100, and the turbine 120 is disposed on a downstream side of the gas turbine 100. The combustor 1000 is arranged between the compressor 110 and the turbine 120.

The compressor 110 includes compressor vanes and a compressor rotor including a compressor disk and compressor blades in a compressor casing. The turbine 120 includes turbine vanes and a turbine rotor including a turbine disk and turbine blades in a turbine casing. The compressor vanes and the compressor rotor are arranged in a multi-stage along a flow direction of compressed air, and the turbine vanes and the turbine rotor are also arranged in a multi-stage along a flow direction of combustion gas.

The compressor 110 has an internal space of which volume decreases from a front-stage toward a rear-stage so that the introduced air can be compressed while passing through the inside of the compressor 110, whereas the turbine 120 has an internal space of which a volume increases from a front-stage toward a rear-stage so that the combustion gas supplied from the combustor 1000 can expand while passing through the inside of the turbine 120.

In addition, a torque tube serving as a torque transmission member is disposed between the last-stage compressor rotor and the first-stage turbine rotor to transmit rotational torque generated by the turbine 120 to the compressor 110. Although the torque tube may include a plurality of torque tube disks arranged in three stages as illustrated in FIG. 1, this is only an example, and the torque tube may include a plurality of torque tube disks arranged in four or more stages or two or less stages.

The compressor rotor includes a compressor disk and a plurality of compressor blades. A plurality of compressor disks may be disposed inside the compressor casing, and each of the compressor disks is fastened by a tie road so as not to be separated from each other in an axial direction. That is, the compressor disks are aligned along the axial direction with the tie rod extending through centrals thereof. In addition, adjacent compressor disks are arranged such that opposing surfaces of the adjacent compressor disks are compressed by the tie rod so that the compressor disks cannot rotate relative to each other.

The plurality of compressor blades are radially coupled to an outer surface of each of the compressor disks along a circumferential direction. For each compressor stage, the plurality of compressor vanes coupled to an inner surface of the compressor casing along the circumferential direction are alternately arranged with the plurality of compressor blades. While the compressor disks rotate along with a rotation of the tie rod, the compressor vanes fixed to the compressor casing do not rotate. The compressor vanes align the flow of compressed air passing through the compressor blades and guide the flow of the compressed air moved from front-stage compressor blades to rear-stage compressor blades. Here, the compressor casing and the compressor vanes may be collectively defined as a compressor stator to distinguish them from the compressor rotor.

The tie rod is arranged to extend through the centers of the plurality of compressor disks and the plurality of turbine disks, such that one end thereof is fastened to the compressor disk located on the foremost end side of the compressor and the other end thereof is fastened by a fastening nut.

Because the tie rod may be formed in various structures depending on a type of the gas turbine, a shape of the tie rod is not limited to the example illustrated in FIG. 1. There are three types of tie rod including: a single-type in which a single tie rod extends through the centers of the compressor disks and the turbine disks; a multi-type in which multiple tie rods are arranged in a circumferential direction; and a complex type in which the single-type and the multi-type are combined.

Also, the compressor may include a deswirler that serves as a guide blade. The deswirler increases a pressure of fluid flowing into the combustor and adjusts a flow angle of the fluid to be substantially equal to a designed flow angle.

The combustor 1000 serves to mix an incoming compressed air with fuel supplied from a fuel injector and combust the air-fuel mixture to produce high-temperature and high-pressure combustion gas with high energy, thereby raising the temperature of the combustion gas to the heat-resistant temperature at which the components of the combustor and turbine can endure through an isothermal combustion process.

A plurality of combustors constituting the combustor 1000 may be arranged in a form of a cell in a combustor casing. Each combustor includes a nozzle casing 1100, a liner 1200, a transition piece 1300, and a nozzle assembly.

The nozzle assembly is disposed inside of the nozzle casing 1100 to inject fuel and compressed air, and the liner 1200 connected to a rear end (i.e., downstream end) of the nozzle casing 1100 defines a combustion chamber 1210 in which a mixture of fuel supplied from outside and compressed air supplied from the compressor 110 is combusted.

The transition piece 1300 is connected to a rear end (i.e., downstream end) of the liner 1200 to supply combustion gas generated in the combustion chamber 1210 to the turbine 120.

That is, the liner 1200 includes the combustion chamber that provides a combustion space in which fuel and compressed air injected from the nozzle assembly are mixed and burned and a liner annular flow path that surrounds the combustion chamber 1210 to provide an annular space. The nozzle assembly is installed at a front end of the liner 1200 and an igniter is installed at a sidewall of the liner.

In the liner annular flow path, compressed air introduced through a plurality of holes formed in an outer wall of the liner 1200 flows, and the introduced compressed air cools the liner 1200 while flowing toward the transition piece 1300. Because the compressed air flows along the outer wall of the liner 1200, it is possible to prevent the liner 1200 from being thermally damaged by high temperature combustion gas.

The transition piece 1300 is connected to the rear end (i.e., downstream end) of the liner to transfer the combustion gas to the turbine. The transition piece 1300 has an annular flow path surrounding an inner space of the transition piece 1300. As the compressed air flows along the annular flow path, an outer wall of the transition piece is cooled by the compressed air to prevent thermal damage by high temperature combustion gas.

The high-temperature and high-pressure combustion gas supplied to the turbine 120 expands while passing through the inside of the turbine 120. The expansion of the combustion gas causes impulses and reaction forces with respect to the turbine blades, thereby generating rotational torque. The rotational torque is transmitted to the compressor through the torque tube, and an excessive portion the rotational torque exceeding the power required to drive the compressor is used to drive a generator or the like.

The turbine 120 is similar in structure to the compressor 110. That is, the turbine 120 includes a plurality of turbine rotors similar to the compressor rotors of the compressor 110. Each turbine rotor includes a turbine disk and a plurality of turbine blades radially disposed around the turbine disk. The turbine disk and the plurality of turbine blades are designed in a structure in which they are arranged in a multi-stage to be spaced apart from each other along a flow direction of the combustion gas. A plurality of turbine vanes are radially coupled to the inner surface of the turbine casing along the circumferential direction such that each stage of turbine vanes is disposed between adjacent stages of turbine blades to guide a flow direction of the combustion gas passing through the turbine blades. Here, the turbine casing and the turbine vanes may be collectively defined as a turbine stator to distinguish them from the turbine rotor.

Figure 2:
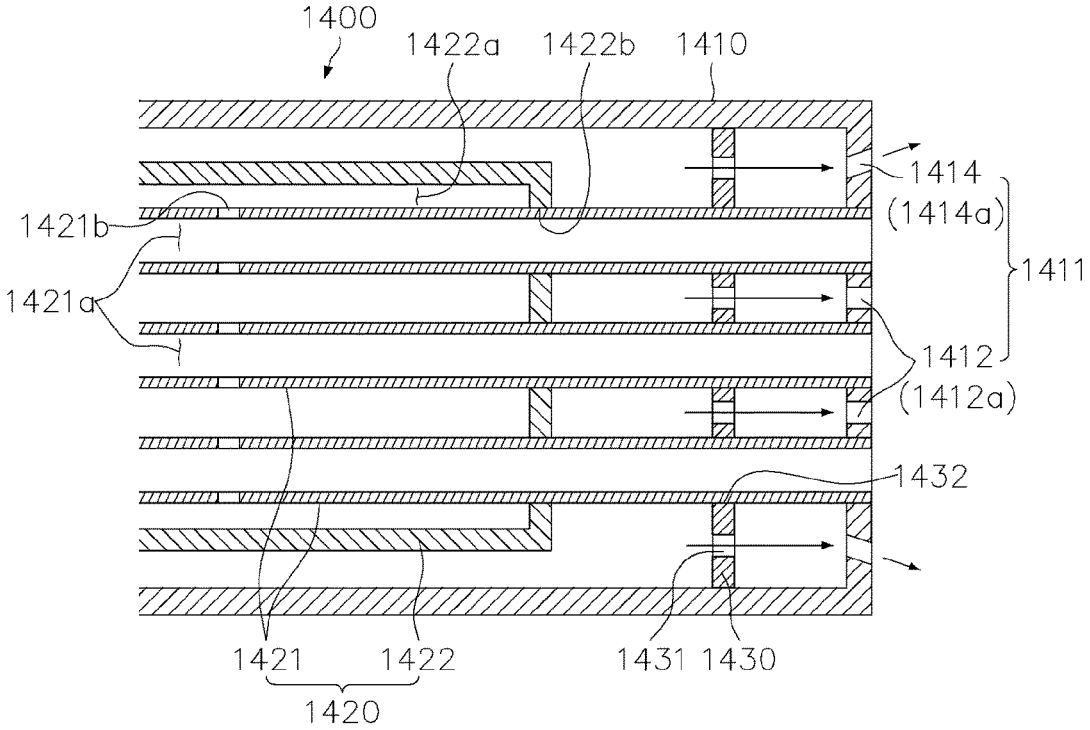
FIG. 2 is an enlarged view illustrating a part of a nozzle assembly provided in a combustor illustrated in FIG. 1 according to a first exemplary embodiment.
Figure 3:
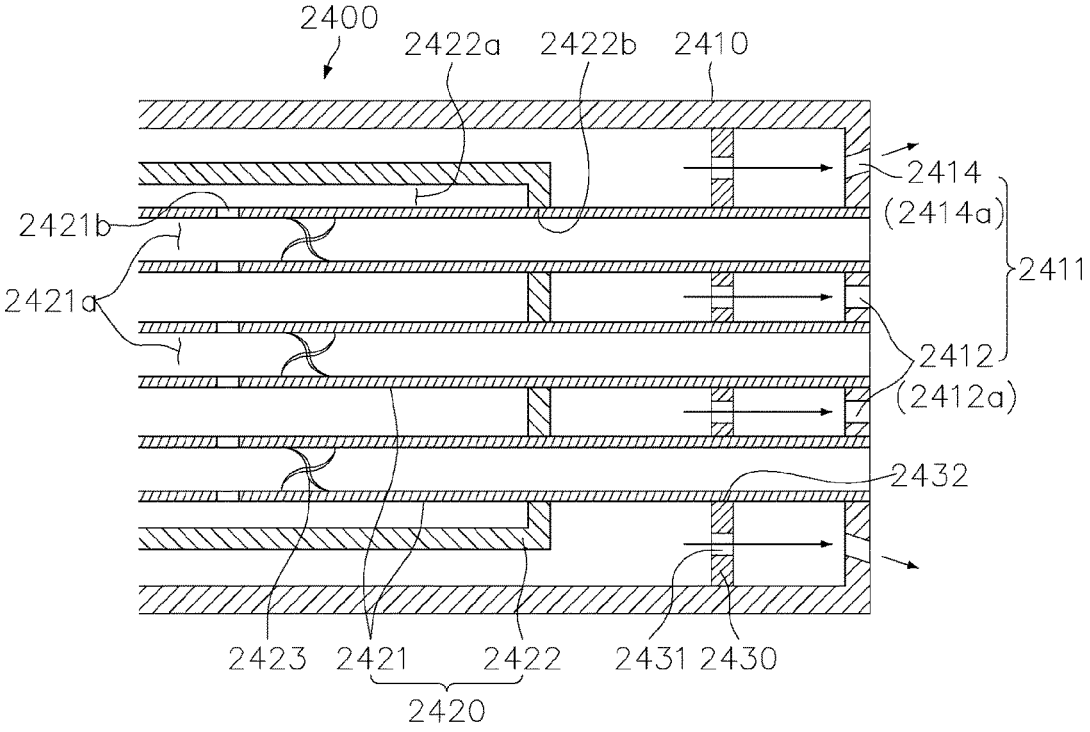
FIG. 3 is an enlarged view illustrating a part of a nozzle assembly provided in a combustor illustrated in FIG. 1 according to a second exemplary embodiment.
Figure 4:
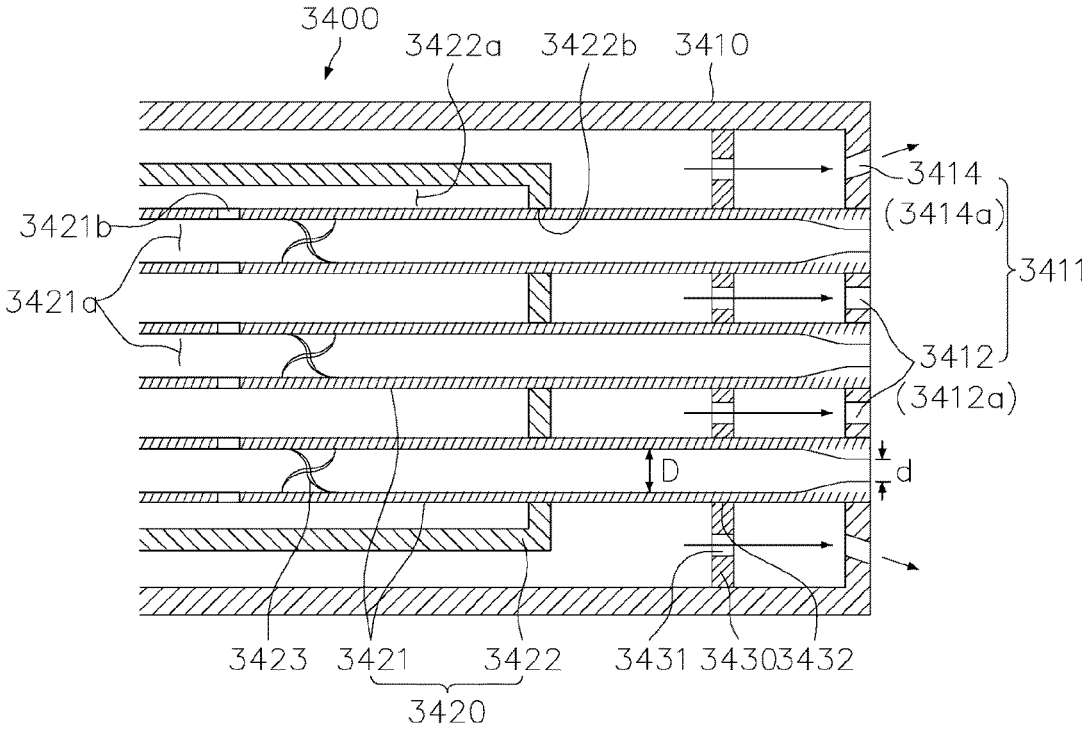
FIG. 4 is an enlarged view illustrating a part of a nozzle assembly provided in a combustor illustrated in FIG. 1 according to a third exemplary embodiment.
Figure 5:
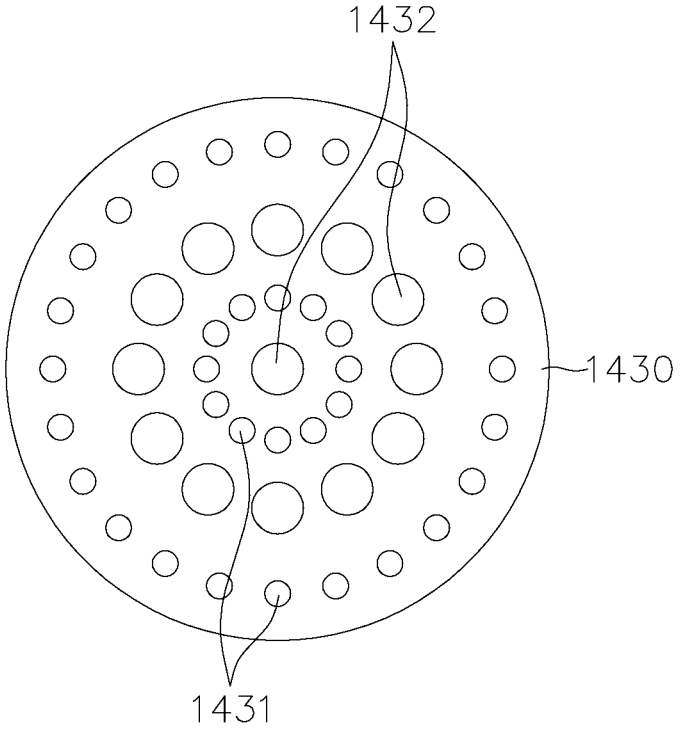
FIG. 5 is a front view illustrating a diaphragm provided in a nozzle body illustrated in FIG. 2.
Figure 6:
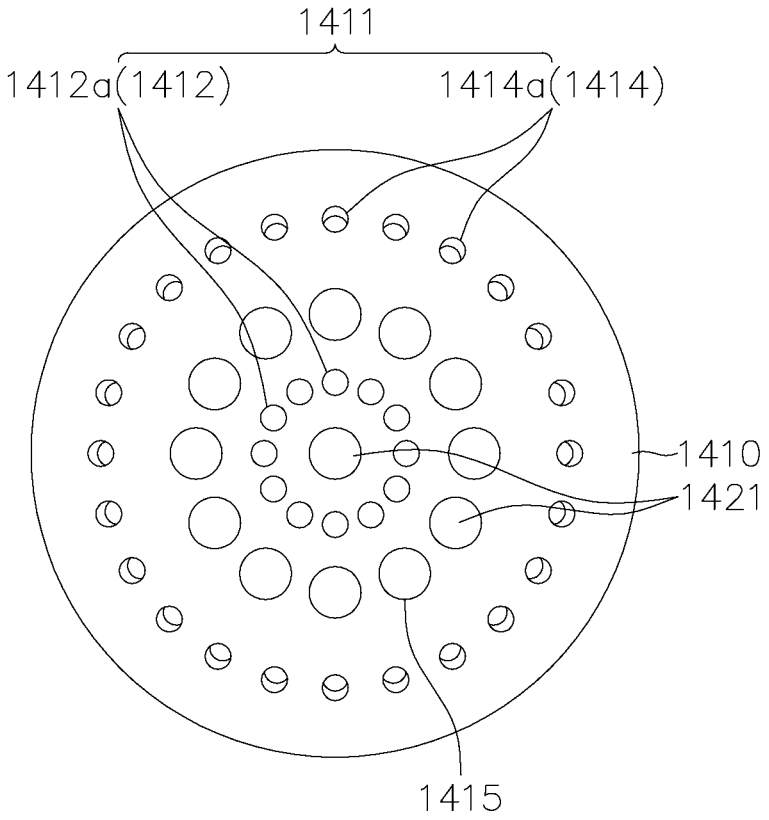
FIG. 6 is a side view illustrating the nozzle body illustrated in FIG. 2.

FIG. 2 is an enlarged view illustrating a part of a nozzle assembly 1400 provided in a combustor illustrated in FIG. 1 according to a first exemplary embodiment. FIG. 3 is an enlarged view illustrating a part of a nozzle assembly 2400 provided in a combustor illustrated in FIG. 1 according to a second exemplary embodiment. FIG. 4 is an enlarged view illustrating a part of a nozzle assembly 3400 provided in a combustor illustrated in FIG. 1 according to a third exemplary embodiment. FIG. 5 is a front view illustrating a diaphragm provided in a nozzle body illustrated in FIG. 2. FIG. 6 is a side view illustrating the nozzle body 1410 illustrated in FIG. 2.

Referring to FIGS. 2 to 4, the nozzle assembly 1400 includes a nozzle body 1410, a spray nozzle 1420, and a diaphragm 1430. The nozzle body 1410 has a cylindrical shape with one end closed and is disposed on the upstream side in the flow direction of combustion gas from the combustion chamber 1210 of the liner 1200. Accordingly, the nozzle body 1410 separates an inner space of the combustion chamber 1210 and the nozzle casing 1100.

The closed end of the nozzle body 1410 is provided with a coolant outlet 1411 including a plurality of coolant outlet holes 1412*a* and 1414*a* arranged in a ring shape so that the inside of the nozzle body 1410 and the combustion chamber 1210 communicate with each other, and a plurality of insertion holes 1415 into which a first nozzle tube 1421 of the spray nozzle 1420 is inserted.

Referring to FIGS. 2 and 5, the diaphragm 1430 disposed inside of the nozzle body 1410 includes a plurality of coolant flow holes 1431 through which a coolant supplied to the nozzle body 1410 is supplied towards one end of the nozzle body 1410 and a plurality of tube holes 1432 through which the first nozzle tubes 1421 pass.

Referring to FIG. 6, the coolant outlet 1411 includes a first coolant outlet part 1412 and a second coolant outlet part 1414. The first coolant outlet part 1412 is formed such that a plurality of coolant outlet holes 1412*a* are arranged in a ring shape along a circumference of an inner periphery of the closed end of the nozzle body 1410, and the second coolant outlet part 1414 is formed such that a plurality of coolant outlet holes 1414*a* are arranged in a ring shape along a circumference of an outer periphery of the closed end of the nozzle body 1410. Here, the coolant outlet holes 1414*a* of the second coolant outlet part 1414 are formed to extend obliquely upward in a longitudinal direction of the nozzle body 1410 from inside to outside through the closed end of the nozzle body 1410.

Cooling air as a coolant is supplied to the nozzle body 1410 to cool the nozzle body 1410. For example, the cooling air is supplied to the inside of the closed end of the nozzle body 1410 through coolant flow holes 1431 of the diaphragm 1430 to cool the nozzle body 1410. After cooling the nozzle body 1410, the cooling air is sprayed to the outside of the nozzle body 1410 through the second coolant outlet part 1414, and a flame generated by combustion gas and fuel injected from the spray nozzle 1420 do not adhere to an outer wall of the spray nozzle 1420, thereby preventing a flame holding phenomenon or a backfire/flashback phenomenon from occurring in the spray nozzle 1420. The cooling air includes compressed air supplied from the compressor 110. A part of the compressed air supplied from the compressor is supplied as cooling air and the rest as combustion air. It is understood that external air or cooling water may be used as a cooling air to cool the nozzle.

Referring to FIG. 2, the spray nozzle 1420 is installed in the nozzle body 1410 to inject fuel and combustion air into the combustion chamber 1210. Here, the injected fuel may be hydrogen. The spray nozzle 1420 includes a plurality of first nozzle tubes 1421 and a second nozzle tube 1422. Each of the first nozzle tubes 1421 includes a first flow path 1421*a* through which combustion air is supplied toward the combustion chamber 1210 and a fuel hole 1421*b* formed on the circumference thereof so that fuel is supplied. The second nozzle tube 1422 is disposed adjacent to the first nozzle tubes 1421 and includes a plurality of through-holes 1422*b* through which the first nozzle tubes 1421 pass. The second nozzle tube 1422 has a cylindrical shape with one end closed, and the through-holes 1422*b* are formed on the closed end. In addition, a second flow path 1422*a* through which fuel is supplied to the outside is formed inside the second nozzle tube 1422.

The fuel supplied to the upstream side of the second nozzle tube 1422 flows toward the downstream side of the second nozzle tube 1422 through the second flow path 1422*a* and is supplied to the first flow paths 1421*a* of the first nozzle tubes 1421 through the fuel holes 1421*b* formed on the circumferences of the first nozzle tubes 1421. Then, the fuel is mixed with the combustion air flowing through the first flow path 1421*a* and injected toward the combustion chamber 1210.

Referring to FIG. 3, a nozzle assembly 2400 according to a second exemplary embodiment is the same as the nozzle assembly 1400 according to the first exemplary embodiment, except that a swirler 2423 is provided inside a first nozzle tube 2421, so a description of the configuration overlapping with the nozzle assembly 1400 will be omitted.

Because the swirler 2423 is provided inside the first nozzle tube 2421, the mixing efficiency of fuel and combustion gas that are mixed while the combustion air flows from the upstream side toward the downstream side of the first flow path 2421*a* increases. Because the swirler 2423 is known technology in the art, a detailed description thereof will be omitted. The swirler 2423 is preferably disposed on the downstream side of the first flow path 2421*a* rather than a position in which the fuel hole 2421*b* through which fuel is supplied to the first flow path 2421*a* is formed based on a flow direction of combustion air flowing through the first flow path 2421*a*. If the combustion air and fuel flowing along the circumference of the first flow path 2421*a* pass through the swirler 2433, the combustion air and fuel are concentrated in the central portion of the first flow path 2421*a*, thereby increasing the mixing efficiency of the combustion air and fuel.

Referring to FIG. 4, a nozzle assembly 3400 according to a third exemplary embodiment is the same as the nozzle assembly 2400 according to the second exemplary embodiment, except that a cross-sectional area d on the outlet side of a first nozzle tube 3421 gradually decreases compared to a cross-sectional area D on the inlet side of the first nozzle tube 3421, so a description of a configuration overlapping with the nozzle assembly 2400 will be omitted.

Because a cross-sectional area of the first nozzle tube 3421 gradually decreases from the outlet side (i.e., area d) to the inlet side (i.e., area D), the spray speed of combustion air and fuel injected into the combustion chamber 1210 through the outlet of the first nozzle tube 3421 increases so that an air-fuel mixture is combusted relatively downstream side compared to a related art combustion spot, thereby preventing the flame holding phenomenon or backfire/flashback phenomenon from occurring on the spray nozzle 3420.

In the fuel assembly 1400, 2400, and 3400, as compressed air is supplied to the combustion chamber 1210 through the nozzle body 1410, the spray nozzle 1420 can be cooled using the compressed air supplied to the combustion chamber 1210, and the swirler 2423 is formed inside the first nozzle tube 2421 of the spray nozzle 2420 to increase the mixing efficiency of fuel and combustion air that are supplied to the first flow path 2421*a* of the spray nozzle 2420, and the first flow path 3421*a* has a cross-sectional area that gradually decreases toward an outlet side thereof to increase the spray speed of combustion air and fuel so that an air-fuel mixture is combusted relatively downstream side compared to the related art combustion point.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A nozzle assembly for injecting fuel and compressed air into a combustion chamber of a gas turbine combustor, the nozzle assembly comprising:

a nozzle body disposed in the combustor and having a coolant outlet on one end of which an inside of the nozzle body communicates with the combustion chamber;

a spray nozzle disposed in the nozzle body and including a plurality of first nozzle tubes, each first nozzle tube having a first flow path formed therein to allow combustion air to flow into the combustion chamber and a fuel hole formed on a circumferential surface thereof to supply fuel, and a second nozzle tube disposed adjacent to the first nozzle tube and having a plurality of through-holes to allow the first nozzle tubes to pass therethrough and a second flow path formed therein to supply fuel; and a diaphragm disposed inside of the nozzle body and including a plurality of coolant flow holes through which a coolant supplied to the nozzle body is supplied towards one end of the nozzle body, and a plurality of tube holes through which the first nozzle tubes pass.

2. The nozzle assembly according to claim 1, wherein the nozzle body has a cylindrical shape with one closed end on which the coolant outlet is formed, wherein the coolant outlet includes a plurality of coolant outlet holes arranged in a ring shape.

3. The nozzle assembly according to claim 2, wherein the plurality of coolant outlet holes include:

a first group of coolant outlet holes arranged in a circumferential direction in the ring shape on an inner circumferential portion of the closed end of the nozzle body; and a second group of coolant outlet holes arranged in the circumferential direction in the ring shape on an outer circumferential portion of the closed end of the nozzle body.

4. The nozzle assembly according to claim 3, wherein the coolant outlet holes of the second group of coolant outlet holes are formed to extend obliquely upward in a longitudinal direction of the nozzle body from inside to outside through the closed end of the nozzle body.

5. The nozzle assembly according to claim 1, wherein a swirler is formed inside the first nozzle tube to mix fuel and combustion air supplied to the first nozzle tube.

6. The nozzle assembly according to claim 5, wherein the swirler is disposed in the first flow path downstream from a position in which the fuel hole is formed based on a flow direction of combustion air flowing through the first flow path.

7. The nozzle assembly according to claim 6, wherein the first flow path has a cross-sectional area gradually decreasing toward an outlet side thereof.

8. A combustor comprising:

a nozzle casing configured to receive compressed air from a compressor and to receive fuel from an outside;

a liner connected to the nozzle casing and defining a combustion chamber in which a mixture of the compressed air-fuel is combusted;

a transition piece connected to the liner to supply combustion gas generated in the combustion chamber to a turbine; and a nozzle assembly disposed in the nozzle casing to inject fuel and compressed air into the combustion chamber, wherein the nozzle assembly comprises:

a nozzle body disposed in the combustor and having a coolant outlet on one end of which an inside of the nozzle body communicates with the combustion chamber;

a spray nozzle disposed in the nozzle body and including a plurality of first nozzle tubes, each first nozzle tube having a first flow path formed therein to allow combustion air to flow into the combustion chamber and a fuel hole formed on a circumferential surface thereof to supply fuel, and a second nozzle tube disposed adjacent to the first nozzle tube and having a plurality of through-holes to allow the first nozzle tubes to pass therethrough and a second flow path formed therein to supply fuel; and a diaphragm disposed inside of the nozzle body and including a plurality of coolant flow holes through which a coolant supplied to the nozzle body is supplied towards one end of the nozzle body, and a plurality of tube holes through which the first nozzle tubes pass.

9. The combustor according to claim 8, wherein the nozzle body has a cylindrical shape with one closed end on which the coolant outlet is formed, wherein the coolant outlet includes a plurality of coolant outlet holes arranged in a ring shape.

10. The combustor according to claim 9, wherein the plurality of coolant outlet holes include:

a first group of coolant outlet holes arranged in a circumferential direction in the ring shape on an inner circumferential portion of the closed end of the nozzle body; and a second group of coolant outlet holes arranged in the circumferential direction in the ring shape on an outer circumferential portion of the closed end of the nozzle body.

11. The combustor according to claim 10, wherein the coolant outlet holes of the second group of coolant outlet holes are formed to extend obliquely upward in a longitudinal direction of the nozzle body from inside to outside through the closed end of the nozzle body.

12. The combustor according to claim 8, wherein a swirler is formed inside the first nozzle tube to mix fuel and combustion air supplied to the first nozzle tube.

13. The combustor according to claim 12, wherein the swirler is disposed in the first flow path downstream from a position in which the fuel hole is formed based on a flow direction of combustion air flowing through the first flow path.

14. The combustor according to claim 13, wherein the first flow path has a cross-sectional area gradually decreasing toward an outlet side thereof.

15. A gas turbine comprising:

a compressor configured to suck and compress external air;

a combustor configured to mix the compressed air supplied from the compressor with fuel and combust the air-fuel mixture to produce combustion gas; and a turbine rotated by the combustion gas produced by the combustor to generate power, wherein the combustor comprises:

a nozzle casing;

a liner connected to the nozzle casing and defining a combustion chamber in which the compressed air-fuel mixture is combusted;

a transition piece connected to the liner to supply combustion gas generated in the combustion chamber to the turbine; and a nozzle assembly disposed in the nozzle casing to inject fuel and compressed air into the combustion chamber, wherein the nozzle assembly comprises:

a nozzle body disposed in the combustor and having a coolant outlet on one end of which an inside of the nozzle body communicates with the combustion chamber;

a spray nozzle disposed in the nozzle body and including a plurality of first nozzle tubes, each first nozzle tube having a first flow path formed therein to allow combustion air to flow into the combustion chamber and a fuel hole formed on a circumferential surface thereof to supply fuel, and a second nozzle tube disposed adjacent to the first nozzle tube and having a plurality of through-holes to allow the first nozzle tubes to pass therethrough and a second flow path formed therein to supply fuel; and a diaphragm disposed inside of the nozzle body and including a plurality of coolant flow holes through which a coolant supplied to the nozzle body is supplied towards one end of the nozzle body, and a plurality of tube holes through which the first nozzle tubes pass.

16. The gas turbine according to claim 15, wherein the nozzle body has a cylindrical shape with one closed end on which the coolant outlet is formed, wherein the coolant outlet includes a plurality of coolant outlet holes arranged in a ring shape, wherein the coolant outlet holes include:

a first group of coolant outlet holes arranged in a circumferential direction in the ring shape on an inner circumferential portion of the closed end of the nozzle body; and a second group of coolant outlet holes arranged in the circumferential direction in the ring shape on an outer circumferential portion of the closed end of the nozzle body.

17. The gas turbine according to claim 16, wherein the coolant outlet holes of the second group of coolant outlet holes are formed to extend obliquely upward in a longitudinal direction of the nozzle body from inside to outside through the closed end of the nozzle body.

18. The gas turbine according to claim 15, wherein a swirler is formed inside the first nozzle tube to mix fuel and combustion air supplied to the first nozzle tube.

19. The gas turbine according to claim 18, wherein the swirler is disposed in the first flow path downstream from a position in which the fuel hole is formed based on a flow direction of combustion air flowing through the first flow path.

20. The gas turbine according to claim 19, wherein the first flow path has a cross-sectional area gradually decreasing toward an outlet side thereof.

* * * * *